US011390821B2

(12) United States Patent
Shanahan et al.

(10) Patent No.: US 11,390,821 B2
(45) Date of Patent: Jul. 19, 2022

(54) FUEL ADDITIVE MIXTURE PROVIDING RAPID INJECTOR CLEAN-UP IN HIGH PRESSURE GASOLINE ENGINES

(71) Applicant: Afton Chemical Corporation, Richmond, VA (US)

(72) Inventors: Charles Shanahan, Richmond, VA (US); Michel Nuckols, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 8 days.

(21) Appl. No.: 16/263,053

(22) Filed: Jan. 31, 2019

(65) Prior Publication Data

US 2020/0248089 A1 Aug. 6, 2020

(51) Int. Cl.

| | |
|---|---|
| ***C10L 1/04*** | (2006.01) |
| ***C10L 1/232*** | (2006.01) |
| ***C10L 10/06*** | (2006.01) |
| ***F02B 47/04*** | (2006.01) |

(52) U.S. Cl.

CPC ..... *C10L 1/232* (2013.01); *C10L 10/06* (2013.01); *F02B 47/04* (2013.01); *C10L 2270/023* (2013.01); *C10L 2300/20* (2013.01)

(58) Field of Classification Search

CPC .. C10L 1/232; C10L 10/04; C10L 2200/0423; C10L 2270/023

See application file for complete search history.

(56) References Cited

U.S. PATENT DOCUMENTS

| | | | |
|---|---|---|---|
| 2,129,264 | A | 9/1938 | Baxter et al. |
| 2,568,876 | A | 9/1951 | White et al. |
| 2,886,423 | A | 5/1959 | Kozikowski |
| 3,015,668 | A | 1/1962 | Kozikowski |
| 3,027,246 | A | 3/1962 | Bartlett |
| 3,092,474 | A | 6/1963 | Ebner |
| 3,198,613 | A | 8/1965 | Udelhofen |
| 3,468,640 | A | 9/1969 | Barusch et al. |
| 3,778,371 | A | 12/1973 | Malec |

(Continued)

FOREIGN PATENT DOCUMENTS

| | | | |
|---|---|---|---|
| CN | 101671584 | A | 3/2010 |
| EP | 0293192 | A1 | 11/1988 |

(Continued)

OTHER PUBLICATIONS

Smith, S. Scott et al. Measurement and Control of Fuel Injector Deposits in Direct Injection Gasoline Vehicles. SAE International; Oct. 14, 2013. doi:10.4271/2013-01-2616.

(Continued)

*Primary Examiner* — Ellen M McAvoy
*Assistant Examiner* — Ming Cheung Po
(74) *Attorney, Agent, or Firm* — Honigman LLP

(57) ABSTRACT

The present disclosure relates to methods and fuel compositions for reducing or eliminating fuel injector deposits in high pressure gasoline engines. The fuel compositions include gasoline and a synergistic combination of a fuel injector clean-up mixture including a heterocyclic amine, diamine, or open chain derivative thereof and a hydrocarbyl substituted dicarboxylic anhydride derivative selected from a diamide, acid/amide, acid/ester, diacid, amide/ester, diester, and imide.

15 Claims, 1 Drawing Sheet

(56) References Cited

U.S. PATENT DOCUMENTS

| | | | | |
|---|---|---|---|---|
| 4,056,531 | A | 11/1977 | Malec | |
| 4,067,698 | A | 1/1978 | Steckel | |
| 4,152,499 | A | 5/1979 | Boerzel et al. | |
| 4,171,959 | A | 10/1979 | Vartanian | |
| 4,234,435 | A | 11/1980 | Meinhardt et al. | |
| 4,248,719 | A | 2/1981 | Chafetz et al. | |
| 4,253,980 | A | 3/1981 | Hammond et al. | |
| 4,326,973 | A | 4/1982 | Hammond et al. | |
| 4,338,206 | A | 7/1982 | Hammond et al. | |
| 4,482,357 | A | 11/1984 | Hanlon | |
| 4,531,948 | A * | 7/1985 | Knapp | C10L 1/143 252/392 |
| 4,666,460 | A * | 5/1987 | Wollenberg | C10L 1/2383 44/348 |
| 4,787,916 | A | 11/1988 | Feldman | |
| 5,024,677 | A * | 6/1991 | Wang | C10L 1/22 44/451 |
| 5,250,174 | A | 10/1993 | Hart | |
| 5,254,138 | A | 10/1993 | Kurek | |
| 5,330,667 | A | 7/1994 | Tiffany, III | |
| 5,393,309 | A * | 2/1995 | Cherpeck | C10L 1/143 44/347 |
| 5,575,823 | A | 11/1996 | Wallace et al. | |
| 5,752,989 | A | 5/1998 | Henly et al. | |
| 5,756,428 | A | 5/1998 | Emert et al. | |
| 6,405,711 | B1 | 6/2002 | Smith | |
| 6,462,014 | B1 | 10/2002 | Johnson | |
| 6,733,550 | B1 * | 5/2004 | Grundy | C10L 1/143 44/348 |
| 7,297,675 | B2 | 11/2007 | Alef et al. | |
| 7,402,185 | B2 * | 7/2008 | Aradi | C10M 141/06 44/412 |
| 7,744,660 | B2 | 6/2010 | Burrington et al. | |
| 7,906,470 | B2 | 3/2011 | Stevenson et al. | |
| 7,947,093 | B2 | 5/2011 | Barton et al. | |
| 7,951,211 | B2 | 5/2011 | Barton et al. | |
| 8,475,541 | B2 | 7/2013 | Fang et al. | |
| 8,863,700 | B2 | 10/2014 | Fang et al. | |
| 8,894,726 | B2 | 11/2014 | Fang et al. | |
| 8,961,623 | B2 | 2/2015 | Stevenson et al. | |
| 8,974,551 | B1 | 3/2015 | Fang | |
| 9,062,265 | B2 | 6/2015 | Reid et al. | |
| 9,340,742 | B1 | 5/2016 | Fang et al. | |
| 2003/0014910 | A1 | 1/2003 | Aradi et al. | |
| 2003/0131527 | A1 | 7/2003 | Colucci et al. | |
| 2004/0029766 | A1 | 2/2004 | Frick et al. | |
| 2004/0167040 | A1 | 8/2004 | Dahlmann et al. | |
| 2005/0120619 | A1 | 6/2005 | Koch | |
| 2006/0272597 | A1 | 12/2006 | Burrington et al. | |
| 2007/0015681 | A1 | 1/2007 | Allef et al. | |
| 2007/0193110 | A1 | 8/2007 | Schwab | |
| 2008/0113890 | A1 | 5/2008 | Moreton et al. | |
| 2008/0307698 | A1 | 12/2008 | Barton et al. | |
| 2009/0282731 | A1 | 11/2009 | Malfer et al. | |
| 2010/0024289 | A1 | 2/2010 | Smith | |
| 2010/0037513 | A1 | 2/2010 | Petrucci et al. | |
| 2010/0037514 | A1 | 2/2010 | Malfer et al. | |
| 2010/0151396 | A1 | 6/2010 | Papachristos et al. | |
| 2010/0236510 | A1 | 9/2010 | Shea et al. | |
| 2011/0185626 | A1 | 8/2011 | Barton et al. | |
| 2011/0237469 | A1 | 9/2011 | Khandekar et al. | |
| 2011/0258917 | A1 | 10/2011 | Garcia et al. | |
| 2011/0302828 | A1 | 12/2011 | Fang et al. | |
| 2011/0308550 | A1 | 12/2011 | Reid | |
| 2011/0315107 | A1 | 12/2011 | Grabarse et al. | |
| 2012/0010112 | A1 | 1/2012 | Grabarse et al. | |
| 2012/0291339 | A1 | 11/2012 | Martin et al. | |
| 2013/0031827 | A1 | 2/2013 | Reid et al. | |
| 2013/0031828 | A1 | 2/2013 | Reid et al. | |
| 2013/0104826 | A1 | 5/2013 | Burgess et al. | |
| 2013/0220255 | A1 | 8/2013 | Fang | |
| 2013/0233267 | A1 | 9/2013 | Barbour | |
| 2013/0296210 | A1 | 11/2013 | Hansch et al. | |
| 2013/0298948 | A1 | 11/2013 | Company et al. | |
| 2013/0333650 | A1 | 12/2013 | Fang et al. | |
| 2014/0157655 | A1 | 6/2014 | Tort et al. | |
| 2014/0174390 | A1 | 6/2014 | Reid et al. | |
| 2015/0033617 | A1 | 2/2015 | Arondel et al. | |
| 2015/0252277 | A1 | 9/2015 | Hansch et al. | |

FOREIGN PATENT DOCUMENTS

| | | | | |
|---|---|---|---|---|
| EP | 0482253 | A1 * | 4/1992 | C10L 1/14 |
| EP | 0482253 | A1 * | 4/1992 | |
| EP | 1518918 | A1 * | 3/2005 | C10L 1/221 |
| EP | 1518918 | A1 | 3/2005 | |
| EP | 2033945 | A1 | 3/2009 | |
| EP | 2674471 | A1 | 12/2013 | |
| EP | 2987845 | A1 | 2/2016 | |
| GB | 0842728 | A1 | 7/1960 | |
| WO | 2010132209 | A1 | 11/2010 | |
| WO | 2013000738 | A2 | 1/2013 | |
| WO | 2013017889 | A1 | 2/2013 | |
| WO | 2013070503 | A1 | 5/2013 | |
| WO | 2013092533 | A1 | 6/2013 | |
| WO | 2015011505 | A1 | 1/2015 | |
| WO | 2017168312 | A1 | 10/2017 | |

OTHER PUBLICATIONS

European Patent Office, Extended European Search Report for EP Application No. 20154210.7, dated Jun. 25, 2020.

* cited by examiner

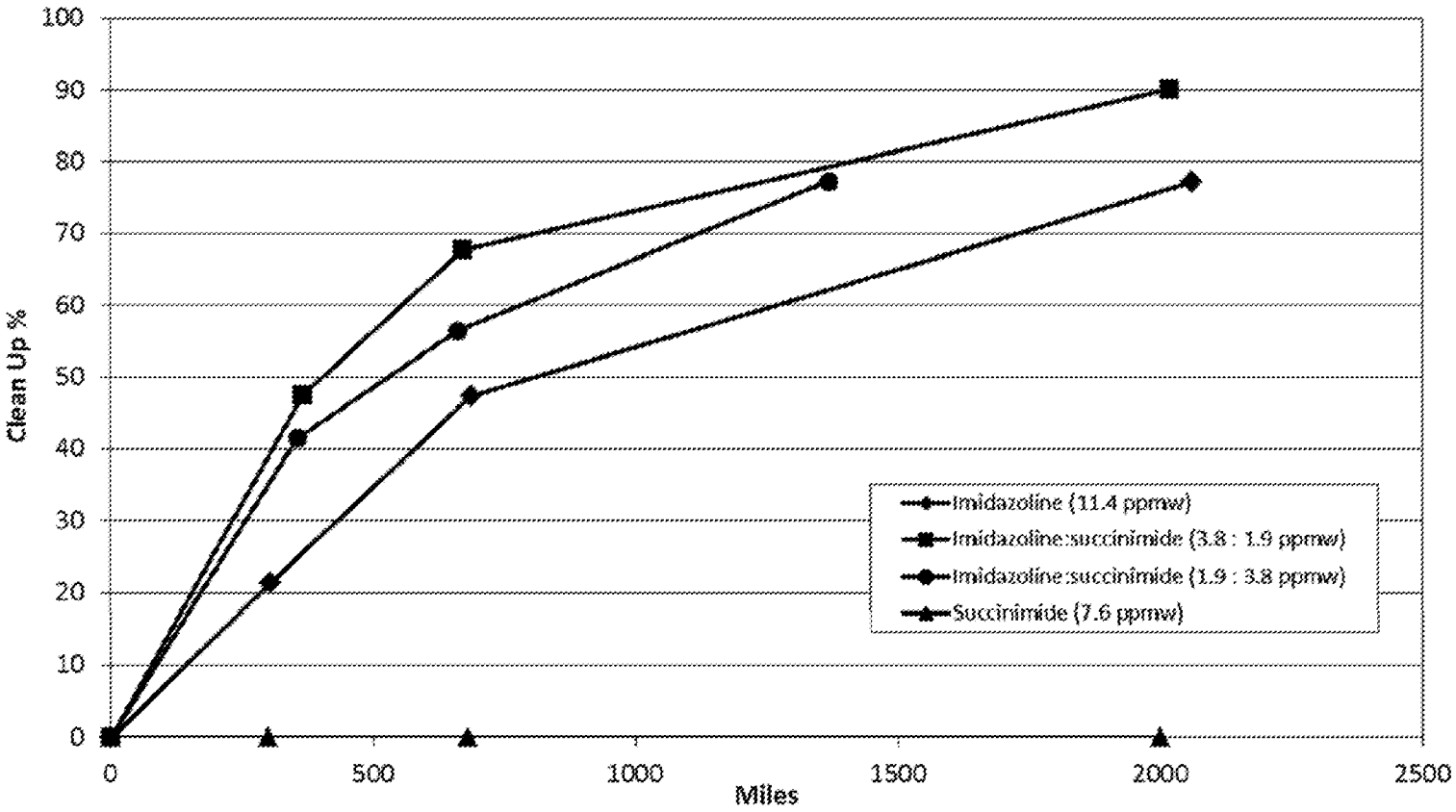
Clean Up %
100
90
80
70
60
50
40
30
20
10
0
0
500
1000
1500
2000
2500
Miles
Imidazoline (11.4 ppmw)
Imidazoline:succinimide (3.8 : 1.9 ppmw)
Imidazoline:succinimide (1.9 : 3.8 ppmw)
Succinimide (7.6 ppmw)

FUEL ADDITIVE MIXTURE PROVIDING RAPID INJECTOR CLEAN-UP IN HIGH PRESSURE GASOLINE ENGINES

FIELD

The present disclosure relates to methods for reducing fuel injector deposits in gasoline engines operating at high fuel pressures. More particularly, the disclosure relates to methods of rapidly cleaning up fuel injectors operating at high fuel pressures by combusting a gasoline composition including a synergistic combination of a fuel-soluble cleaning mixture

BACKGROUND

Over the years considerable work has been devoted to additives for controlling (preventing or reducing) deposit formation in the fuel induction systems of gasoline internal combustion engines. In particular, additives that can effectively control fuel injector deposits, intake valve deposits, and combustion chamber deposits represent the focal point of considerable research activities in the field. However, prior fuel additives are often less effective when used in newer engine technology.

Newer engine technology, for instance, includes systems that supply fuel at dramatically increased fuel pressure and, because of this high fuel pressure, new engine technology presents challenges not found in prior combustion systems running at substantially lower fuel pressures. For example, prior carbureted engines typically operated at a fuel pressure of 4 to 15 psi and prior multi-port fuel injected engines are designed to operate at 30 to 60 psi. Newer engine technology, on the other hand, is being developed for non-idle operation at greater than 500 psi fuel pressure. In view of this difference, there are a number of technical issues to be resolved with this new engine technology, and one of them is injector performance and cleanliness when operated at such dramatically higher fuel pressures.

Unfortunately, conventional fuel additives often found effective when combusted in gasoline engines operating at lower fuel pressures do not necessarily translate to the same performance when combusted in gasoline engines that are operated at fuel pressures 15 to even 100 times higher. For instance, fuel additives, such as hydrocarbyl substituted succinimides, often used as detergents in fuel for keeping injectors clean when operated at low pressures, do not provide the same level of injector performance when operated in gasoline engines at high fuel pressures. In particular, these conventional additives are not effective to provide clean-up performance of already fouled injectors when the engine is operated at the high fuel pressures of newer engine technology. Other prior additives may provide some level of injector clean-up performance, but require considerably higher treat rates and/or lengthy clean-up times to achieve performance.

SUMMARY

FIG. 1 is a graph showing the clean-up performance of fuel injector cleaning mixtures of the present disclosure when combusted in a gasoline engine running at high fuel pressures.

SUMMARY

In one aspect of this disclosure, a method of reducing fuel injector deposits in a gasoline engine is described. In one approach or embodiment, the method includes providing a fuel composition at a pressure of about 500 to about 7,500 psi to a fuel injector of a gasoline engine and combusting the fuel composition in the gasoline engine. The fuel composition includes a major amount of gasoline and a minor amount of a fuel injector clean-up mixture. The fuel injector clean-up mixture includes a first additive of a heterocyclic amine of Formula I, an open chain derivative thereof, or mixtures thereof and a second additive of Formula II (Formula I)

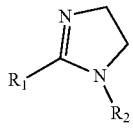

(Formula II)

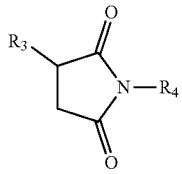

wherein $R_1$ is a hydrocarbyl group having 6 to 80 carbons; $R_2$ is a hydrogen, a hydrocarbyl group having 1 to 20 carbons, a hydroxyalkyl group having 1 to 10 carbons, an acylated hydroxyalkyl group having 1 to 10 carbons, a polyamino group, or an acylated polyamino group; $R_3$ is a hydrocarbyl group; and $R_4$ is hydrogen, an alkyl group, an aryl group, —OH, —$NHR_5$, or a polyamine and wherein $R_5$ is a hydrogen or an alkyl group.

In other aspects or embodiments of this disclosure, the method of the preceding paragraph may be combined or include one or more optional features in any combination thereof. These optional embodiments include: wherein a ratio of the first additive to the second additive is about 1:5 to about 5:1; and/or wherein the fuel composition includes about 1.5 to about 100 ppmw of the first additive and about 3 to about 800 ppmw of the second additive; and/or wherein the fuel composition includes no more than about 600 ppmw of the fuel injector clean-up mixture; and/or wherein the fuel composition further includes about 45 to about 1000 ppmw of a separate intake valve deposit (IVD) control additive selected from a Mannich detergent, polyetheramine detergent, hydrocarbyl amine detergent, and combinations thereof; and/or wherein the fuel composition further includes at least one additive selected from the group consisting of antioxidants, carrier fluids, metal deactivators, dyes, markers, corrosion inhibitors, biocides, antistatic additives, drag reducing agents, demulsifiers, emulsifiers, dehazers, anti-icing additives, antiknock additives, anti-valve-seat recession additives, lubricity additives, surfactants and combustion improvers; and/or wherein the fuel injector clean-up mixture achieves about 30 to about 100 percent clean-up of fuel injector deposits in the gasoline engine when supplied at pressures of about 500 psi to about 7,500 psi and when the clean-up of injector deposits is measured by at least one of long-term fuel trim, injector pulse width, injection duration, injector flow, and combinations thereof; and/or wherein $R_1$ is the hydrocarbyl group having 1 to 20 carbon atoms and $R_2$ is a hydrogen, a hydroxyalkyl group having 1 to 10 carbons, an acylated hydroxyalkyl group having 1 to 10 carbons, a polyamino group, or an acylated polyamino group; and/or wherein $R_2$ is a hydroxyalkyl group having 1 to 10 carbons, an acylated hydroxyalkyl group having 1 to 10 carbons, a polyamino group, or an acylated polyamino group; and/or wherein $R_2$ is a hydroxyalkyl group having 1 to 5 carbons; an acylated hydroxyalkyl group having 1 to 5 carbons; a polyamino group derived from diethyelene triamine, triethylene tetraamine, tetraethylene pentamine, pentaethylene hexamine, N—N'-(iminodi-2,1,ethanediyl)bis-1,3-propanediamine, or combinations thereof; or an acylated polyamino group derived from diethyelene triamine, triethylene tetraamine, tetraethylene pentamine, pentaethylene hexamine, N—N'-(iminodi-2,1,ethanediyl)bis-1,3-propanediamine, and combinations thereof and/or wherein the second additive includes a hydrocarbyl substituted succinimide derived from ethylene diamine, diethyelene triamine, triethylene tetraamine, tetraethylene pentamine, pentaethylene hexamine, N,N'-(iminodi-2,1,ethanediyl)bis-1,3-propanediamine or combinations thereof; and/or wherein $R_3$ in the compound of Formula II is a hydrocarbyl group having a number average molecular weight from about 450 to about 3000 as measured by GPC using polystyrene as a calibration reference and $R_4$ is derived from tetraethylene pentamine or derivatives thereof; and/or wherein the fuel composition is provided at a pressure of about 1000 to about 4,000 psi; and/or wherein $R_1$ is a hydrocarbyl group having 6 to 20 carbons and wherein $R_4$ is derived from ethylene diamine, diethyelene triamine, triethylene tetraamine, tetraethylene pentamine, pentaethylene hexamine, N—N'-(iminodi-2,1,ethanediyl)bis-1,3-propanediamine, and combinations thereof.

In yet a further aspect or embodiment of this disclosure, a fuel additive concentrate for use in gasoline to clean-up fuel injector deposits in a high-pressure gasoline engine is described. In one approach or embodiment, the fuel additive concentrate includes a fuel injector clean-up mixture including a first additive of a heterocyclic amine of Formula I, an open chain derivative thereof, or mixtures thereof and a second additive of Formula II (Formula I)

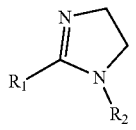

(Formula II)

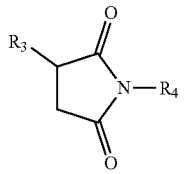

wherein $R_1$ is a hydrocarbyl group having 6 to 80 carbons; $R_2$ is a hydrogen, a hydrocarbyl group having 1 to 20 carbons, a hydroxyalkyl group having 1 to 10 carbons, an acylated hydroxyalkyl group having 1 to 10 carbons, a polyamino group, or an acylated polyamino group; $R_3$ is a hydrocarbyl group; $R_4$ is hydrogen, an alkyl group, an aryl group, —OH, —$NHR_5$, or a polyamine and wherein $R_5$ is a hydrogen or an alkyl group; a ratio of the first additive to the second additive of about 5:1 to about 1:5; and when the fuel additive concentrate is added to gasoline in amounts of no more than 600 ppmw and in the ratio of the first additive to the second additive, the fuel injector clean-up mixture achieves about 50 to about 100 percent clean-up of fuel injector deposits in 5 tanks of fuel or less when the gasoline is supplied at pressure of about 500 to about 7,500 psi and when the clean-up of injector deposits is measured by at least one of long-term fuel trim, injector pulse width, injection duration, injector flow, and combinations thereof.

The fuel additive concentrate of the previous paragraph may be combined with and/or include optional features or embodiments in any combination thereof. These optional features include: wherein $R_1$ is derived from a monocarboxylic acid including 2-ethylhexanoic acid, isostearic acid, capric acid, myristic acid, palmitic acid, stearic acid, tall oil fatty acids, linoleic acid, oleic acid, naphthenic acids, or mixtures thereof; and/or wherein $R_2$ is selected from a hydroxy methyl group, a hydroxy ethyl group, a hydroxy propyl group, and mixtures thereof; and/or wherein $R_2$ is a hydroxyalkyl group having 1 to 5 carbons; an acylated hydroxyalkyl group having 1 to 5 carbons; a polyamino group derived from diethyelene triamine, triethylene tetraamine, tetraethylene pentamine, pentaethylene hexamine, N—N'-(iminodi-2,1,ethanediyl)bis-1,3-propanediamine, or combinations thereof; or an acylated polyamino group derived from diethyelene triamine, triethylene tetraamine, tetraethylene pentamine, pentaethylene hexamine, N—N'-(iminodi-2,1,ethanediyl)bis-1,3-propanediamine, or combinations thereof and/or wherein the second additive includes a hydrocarbyl substituted succinimide derived from ethylene diamine, diethyelene triamine, triethylene tetraamine, tetraethylene pentamine, pentaethylene hexamine, N,N'-(iminodi-2,1,ethanediyl)bis-1,3-propanediamine, or combinations thereof; and/or wherein $R_3$ in the compound of Formula II is a hydrocarbyl group having a number average molecular weight from about 450 to about 3000 as measured by GPC using polystyrene as a calibration reference and $R_4$ is derived from tetraethylene pentamine or derivatives thereof.

The present disclosure also includes the use of any of the features of the fuel additive concentrates described in the previous two paragraphs for the cleaning up of fuel injector deposits as described in those paragraphs.

DETAILED DESCRIPTION

The present disclosure describes methods of rapidly reducing deposits on fuel injectors in a gasoline engine operated at high fuel pressures using a fuel injector clean-up mixture. The present disclosure also describes fuels and fuel additive concentrates including the unique fuel injector clean-up mixture for use in gasoline to rapidly clean-up injector deposits of a high pressure gasoline engine. In one approach or embodiment, the fuel injector clean-up mixtures herein include a synergistic combination of a first fuel injector clean-up additive of a heterocyclic amine, an open chain derivative thereof, or mixtures thereof combined with a second fuel injector clean-up additive of a hydrocarbyl substituted dicarboxylic anhydride derivative. Low treat rates of this synergistic combination of cleaning additives rapidly reduce fuel injector deposits and/or clean-up fouled fuel injectors in a gasoline engine when that engine is operated at high fuel pressures (such as non-idle fuel pressures) greater than about 500 psi (in some approaches, about 500 to about 7,500 psi), and in yet further approaches greater than about 1,000 psi (in other approaches, about 1,000 to about 7,500 psi). It was unexpectedly discovered that the combination of the two cleaning additives together enables a substantially greater and faster level of injector clean-up performance (and in some approaches even at lower treat rates) than either cleaning additive can achieve individually when used in a gasoline fuel at such high fuel pressures.

When injectors become fouled, clean-up of the injectors often requires a number of a tanks of fuel and/or significant accumulated mileage of engine operation to achieve the benefit of the various additives included in the fuel. When combusting prior additives at the extremely high, non-idle pressures of today's newer engines, clean-up is either limited and/or lengthy because it requires a very large number of consecutive fuel tanks and/or extensive engine operation combusting the fuel to achieve performance. The synergistic combinations herein of the first and second additives, on the other hand, unexpectedly provide greater levels of injector clean-up in a limited number of tanks of gasoline and/or a short accumulated operation of the engine as discussed more fully below.

The First Fuel Injector Clean-Up Additive: The first fuel injector clean-up additive of the synergistic combination is a heterocyclic amine, heterocyclic diamine, open chain derivatives thereof, or mixtures thereof. In one approach, the first clean-up additive may be made by the reaction of a monocarboxylic acid and a polyamine to produce the heterocyclic amine (Formula I), heterocyclic diamine, open chain derivatives thereof (Formula IA or IB), or mixtures thereof. In some approaches, the additive may include an equilibrium of the heterocyclic amine or diamine and the open chain derivative(s) thereof as illustrated below. In other approaches, the first fuel injector clean-up additive may include imidazolines, open-chain amides thereof, or mixtures thereof. In another approach, the heterocyclic amine, heterocyclic diamine, or open chain derivative thereof includes a compound selected from Formula I, Formula IA, Formula IB, or mixtures thereof

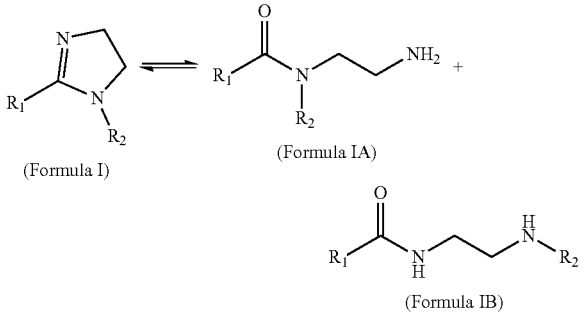

wherein $R_1$ is a hydrocarbyl group having 6 to 80 carbons, and $R_2$ is a hydrogen, a hydrocarbyl group having 1 to 20 carbons, a hydroxyalkyl group having 1 to 10 carbons, an acylated hydroxyalkyl group having 1 to 10 carbons, a polyamino group, or an acylated polyamino group. In some approaches, $R_2$ may be a hydroxy ethyl group, a hydroxy propyl group, and mixtures thereof. In other approaches, $R_1$ is a hydrocarbyl group having 6 to 80 carbons (in other approaches 6 to 20 carbons and in other approaches, 14 to 20 carbons) and $R_2$ is a hydroxy ethyl group, a hydroxy propyl group, and mixtures thereof In yet further approaches, $R_2$ may be a hydroxyalkyl group having 1 to 5 carbons; an acylated hydroxyalkyl group having 1 to 5 carbons; a polyamino group derived from diethyelene triamine, triethylene tetraamine, tetraethylene pentamine, pentaethylene hexamine, N—N'-(iminodi-2,1, ethanediyl)bis-1,3-propanediamine, and combinations thereof; or an acylated polyamino group derived from diethyelene triamine, triethylene tetraamine, tetraethylene pentamine, pentaethylene hexamine, N—N'-(iminodi-2,1, ethanediyl)bis-1,3-propanediamine, or combinations thereof.

In other approaches, the monocarboxylic acids suitable for preparing the heterocyclic amines, diamines, and derivatives thereof may be of Formula III below

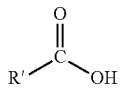

(Formula III)

wherein R' is a saturated or unsaturated, linear, branched or cyclic C6 to C80 hydrocarbyl group (and in other approaches, a C6 to C20 hydrocarbyl group, a C14 to C20 hydrocarbyl group or in other approaches a $C_7$ to $C_{23}$ hydrocarbyl group). Suitable monocarboxylic acids include 2-ethylhexanoic acid, isostearic acid, capric acid, myristic acid, palmitic acid, stearic acid, tall oil fatty acids, linoleic acid, oleic acid, naphthenic acids, as well as isomers and mixtures thereof. In some approaches, the monocarboxylic acids used to form the first fuel injector clean-up additive will contain low amounts of unsaturation, and in some approaches, no unsaturation, such that the first detergent additive has iodine values of 150 or less. As those skilled in the art will appreciate, iodine value is a measure of unsaturation. In some approaches, the first fuel-injector clean-up additive will have an iodine value of 125 or less, more preferably 75 or less, even more preferably 25 or less and most preferably 5 or less.

The polyamines suitable for forming the first detergent additive may be of the formula: $NH_2$—$CH_2$—$CH_2$—NH—R", wherein R" includes $(C_xH_{2x}Z)_yH$ and wherein x is an integer selected from 2 or 3, y is an integer selected from 0 to 4, and Z is —NH or —O. Representative polyamines include ethylenediamine, diethylenetriamine, triethylene tetramine, tetraethylenepentamine, hexaethyleneheptamine, 2-(2-aminoethylamino) ethanol, pentaethylene hexamine, N—N'-(iminodi-2,1,ethanediyl)bis-1,3-propanediamine, or combinations thereof. The polyamines may also include acylated polyamines derived from diethyelene triamine, triethylene tetraamine, tetraethylene pentamine, pentaethylene hexamine, N—N'-(iminodi-2,1,ethanediyl)bis-1,3-propanediamine, or combinations thereof The first fuel injector clean-up additive may be prepared by reacting the monocarboxylic acid and the polyamine under conditions suitable to form the heterocylic polyamines of Formulas I, 1A, or 1B including imidazolines, open-chain amides thereof, or mixtures thereof. The condensation reaction among the monocarboxylic acid and the polyamine may be conducted at a temperature typically in the range of from 40 to 250° C. The reaction can be conducted in bulk (no diluent or solvent) or in a solvent or diluent, for example, a hydrocarbon solvent. Water is evolved and can be removed by azeotropic distillation during the course of the reaction. In one approach, a mole ratio of the monocarboxylic acid to the polyamine may be about 1 to about 3, in other approaches, about 1 to about 2, and in further approaches, about 1 to about 1.5 moles of monocarboxylic acid to 1 mole of polyamine, and in yet other approaches, about 1:1.

While the first fuel injector clean-up additive may provide performance when combusted in high pressure gasoline engines by itself to a limited degree, as discussed more below, the clean-up performance of this additive by itself requires higher treat rates and/or lengthy engine operation. On the other hand, it was unexpectedly discovered that when the first fuel injector clean-up additive is combined with the second fuel injector clean-up additive discussed below, a dramatically improved and rapid clean-up performance of fuel injectors can be achieved when combusted in high pressure gasoline engines.

Second Fuel Injector Clean-Up Additive: The second fuel injector clean-up additive of the synergistic combination, in one approach, is a hydrocarbyl substituted dicarboxylic anhydride derivative. In some approaches, the second cleaning additive includes hydrocarbyl succinimides, succinamides, succinimide-amides and succinimide-esters. These nitrogen-containing derivatives of hydrocarbyl succinic acylating agents may be prepared by reacting a hydrocarbyl-substituted succinic acylating agent with an amine, polyamine, or alkyl amine having one or more primary, secondary, or tertiary amino groups.

In one approach or embodiment, the hydrocarbyl substituted dicarboxylic anhydride derivative may include a hydrocarbyl substituent having a number average molecular weight ranging from about 450 to about 3,000 as measured by GPC using polystyrene as reference. The derivative may be selected from a diamide, acid/amide, acid/ester, diacid, amide/ester, diester, or imide. Such derivative may be made from reacting a hydrocarbyl substituted dicarboxylic anhydride with ammonia, a polyamine, or an alkyl amine having one or more primary, secondary, or tertiary amino groups. In some embodiments, the polyamine or alkyl amine may be tetraethylene pentamine (TEPA), triethylenetetramine (TETA), and the like amines. In other approaches, the polyamine or alkyl amine may have the formula $H_2N$—((CHR'''—$(CH_2)_q$—NH)$_r$—H, wherein R''' is hydrogen or an alkyl group having from 1 to 4 carbon atoms, q is an integer of from 1 to 4 and r is an integer of from 1 to 6, and mixtures thereof. In other approaches, a molar ratio of the hydrocarbyl substituted dicarboxylic anhydride reacted with the ammonia, polyamine, or alkyl amine may be from about 0.5:1 to about 2:1, in other approaches about 1:1 to about 2:1.

In other approaches, the hydrocarbyl substituted dicarboxylic anhydride may be a hydrocarbyl carbonyl compound of the Formula IV below (Formula IV)

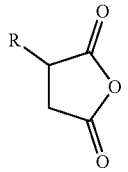

wherein R is a hydrocarbyl group derived from a polyolefin. In some aspects, the hydrocarbyl carbonyl compound may be a polyalkylene succinic anhydride reactant wherein R is a hydrocarbyl moiety, such as for example, a polyalkenyl radical having a number average molecular weight of from about 450 to about 3000 as measured by GPC using polystyrene as reference. For example, the number average molecular weight of R may range from about 600 to about 2500, or from about 700 to about 1500, as measured by GPC using polystyrene as reference. A particularly useful R moiety has a number average molecular weight of about 950 to about 1000 Daltons (as measured by GPC using polystyrene as reference) and comprises polyisobutylene. Unless indicated otherwise, molecular weights in the present specification are number average molecular weights as measured by GPC using polystyrene as reference as discussed more fully below.

The R hydrocarbyl moiety may include one or more polymer units chosen from linear or branched alkenyl units. In some aspects, the alkenyl units may have from about 2 to about 10 carbon atoms. For example, the polyalkenyl radical may comprise one or more linear or branched polymer units chosen from ethylene radicals, propylene radicals, butylene radicals, pentene radicals, hexene radicals, octene radicals and decene radicals. In some aspects, the R polyalkenyl radical may be in the form of, for example, a homopolymer, copolymer or terpolymer. In one aspect, the polyalkenyl radical is isobutylene. For example, the polyalkenyl radical may be a homopolymer of polyisobutylene comprising from about 10 to about 60 isobutylene groups, such as from about 20 to about 30 isobutylene groups. The polyalkenyl compounds used to form the R polyalkenyl radicals may be formed by any suitable methods, such as by conventional catalytic oligomerization of alkenes.

In some aspects, high reactivity polyisobutenes having relatively high proportions of polymer molecules with a terminal vinylidene group may be used to form the $R_5$ group. In one example, at least about 60%, such as about 70% to about 90%, of the polyisobutenes comprise terminal olefinic double bonds. High reactivity polyisobutenes are disclosed, for example, in U.S. Pat. No. 4,152,499, the disclosure of which is herein incorporated by reference in its entirety.

In some aspects, approximately one mole of maleic anhydride may be reacted per mole of polyalkylene, such that the resulting polyalkenyl succinic anhydride has about 0.8 to about 1 succinic anhydride group per polyalkylene substituent. In other aspects, the molar ratio of succinic anhydride groups to polyalkylene groups may range from about 0.5 to about 3.5, such as from about 1 to about 1.1.

The hydrocarbyl carbonyl compounds may be made using any suitable method. One example of a method for forming a hydrocarbyl carbonyl compound comprises blending a polyolefin and maleic anhydride. The polyolefin and maleic anhydride reactants are heated to temperatures of, for example, about 150° C. to about 250° C., optionally, with the use of a catalyst, such as chlorine or peroxide. Another exemplary method of making the polyalkylene succinic anhydrides is described in U.S. Pat. No. 4,234,435, which is incorporated herein by reference in its entirety.

In the hydrocarbyl substituted dicarboxylic anhydride derivative, the polyamine reactant may be an alkylene polyamine. For example, the polyamine may be selected from ethylene polyamine, propylene polyamine, butylenes polyamines, and the like. In one approach, the polyamine is an ethylene polyamine that may be selected from ethylene diamine, diethylene triamine, triethylene tetramine, tetraethylene pentamine, pentaethylene hexamine, and N,N'-(iminodi-2,1,ethanediyl) bis-1,3-propanediamine. A particularly useful ethylene polyamine is a compound of the formula $H_2N$—((CHR'''—$(CH_2)_q$—NH)$_r$—H, wherein R''' is hydrogen, q is 1, and r is 4.

In yet further approaches, the second fuel injector clean-up additive of the synergistic combination is a compound of Formula II below:

(Formula II)

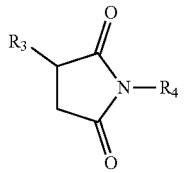

wherein $R_3$ is a hydrocarbyl group as defined above and $R_4$ is a hydrogen, an alkyl group, an aryl group, —OH, —$NHR_5$, or a polyamine, or an alkyl group containing one or more primary, secondary, or tertiary amino groups. $R_5$ may be hydrogen or an alkyl group. In some approaches, $R_4$ is a polyamine derived from ethylene diamine, diethyelene triamine, triethylene tetraamine, tetraethylene pentamine, pentaethylene hexamine, N,N'-(iminodi-2,1,ethanediyl)bis-1,3-propanediamine and combinations thereof. In yet other approaches $R_4$ is a compound or moiety of Formula V:

(Formula V)

$$-((CH_2)_m-A)_n-(CH_2)_p-NR_7R_8$$

wherein A is $NR_6$ or an oxygen atom; $R_6$, $R_7$, and $R_8$ are independently a hydrogen atom or an alkyl group; m and p are integers from 2 to 8; and n is an integer from 0 to 4. In some approaches, $R_7$ and $R_8$ of Formula II, together with the nitrogen atom to which they are attached, form a 5 membered ring.

As shown in the Examples below, the hydrocarbyl substituted dicarboxylic anhydride derivative when used by itself in a high pressure gasoline engine provides no fuel injector clean-up performance. In view of this, it was not expected that combining this second fuel-injector clean-up additive with the first fuel injector clean-up additive would result in a rapid and high level of injector clean-up performance.

Synergistic Combination: The above-described fuel injector clean-up mixture (including the synergistic combination of the first fuel injector clean-up additive of a heterocyclic amine, heterocyclic diamine, open chain derivatives thereof, or mixtures thereof together with the second fuel injector clean-up additive of a hydrocarbyl substituted dicarboxylic anhydride derivative) achieves rapid clean-up of fouled injectors when added to gasoline and combusted in a high pressure gasoline engine operated at fuel pressures, such as non-idle fuel pressures, greater than 500 psi and, in other approaches, from about 500 to about 7,500 psi (in yet further approaches, greater than about 1,000 psi and/or from about 1,000 psi to about 7,500 psi). By clean-up, it is meant the reduction or elimination of existing fuel injector deposits in a gasoline engine when operated at such high pressures. For example, the synergistic combination is preferably added to the fuel in proportions effective to reduce the amount of injector deposits in a gasoline engine operated on the fuel at about 500 to about 7,500 psi containing the synergistic combination to below the amount of injector deposits in the same engine operated in the same manner on the same fuel except that it is devoid of the new synergetic cleaning mixture. Economically, it is desirable to use the least amount of additive effective for the desired purpose. One advantage of the synergistic cleaning mixture herein is that such mixture achieves, in some instances, rapid injector clean-up at low treat rates, which in some approaches further enables the addition of other additives to the fuel as described more below.

In some approaches, the synergistic combination (that is, the first fuel injector clean-up additive of the heterocyclic amine, heterocyclic diamine, open chain derivatives thereof, or mixtures thereof and the second fuel injector clean-up additive of a hydrocarbyl substituted dicarboxylic anhydride derivative selected from a diamide, acid/amide, acid/ester, diacid, amide/ester, diester, and imide) is added to gasoline in amounts up to about 1000 ppmw, up to about 600 ppmw, up to about 400 ppmw, up to about ppmw, or up to about 100 ppmw. In yet other approaches, the synergistic combination is provided in the fuel in amounts ranging from about 4 to about 600 ppmw, in other approaches, about 10 to about 250 ppmw, and in yet other approaches, about 15 to about 100 ppmw. This synergistic combination also may include a ratio of the first fuel-injector clean-up additive to the second fuel injector clean-up additive of about 5:1 to about 1:5 and, in other approaches, about 2:1 to about 1:2. In yet other approaches, the synergistic combination is provided in the fuel in amounts ranging from about 0.5 to about 12 ppmw, in other approaches, about 1 to 8 ppmw, in yet further approaches, about 1.5 to 6 ppmw, and in yet even further approaches about 0.5 to about 6 ppmw In other embodiments, the gasoline includes about 1 to about 200 ppmw of the first fuel injector clean-up additive of the heterocyclic amine, diamine, or open chain derivative thereof (in other approaches, about 1 to 20 ppmw, about 3 to about 20 ppmw, about 1 to about 10 ppmw, or about 3 to about 10 ppmw of the first additive) and about 1 to about 200 ppmw of the second fuel injector clean-up additive of the hydrocarbyl substituted dicarboxylic anhydride derivative selected from a diamide, acid/amide, acid/ester, diacid, amide/ester, diester, and imide (in other approaches, about 1 to about 10 ppmw, about 1 to about 5 ppmw. Or about 3 to about 20 ppmw of the second additive) where the ratio of the first to the second additive remains as discussed above at the same time. Other endpoints within the ranges describes above and in the previous paragraph are also within this disclosure.

When combusting gasoline having the synergistic combination of additives discussed above within a high pressure gasoline engine, the synergistic combinations herein surprisingly achieve a rapid clean-up of fuel injectors, such as about 30 to about 100 percent clean-up of exiting fuel injector deposits in a direct injection gasoline engine as measured by LTFT (long-term fuel trim), injector pulse width, injection duration, and/or injector flow to suggest but a few methods of measuring cleanliness. In one approach, fuel injector deposit clean-up is measured per SAE 2013-01-2626 and/or 2013-01-2616 (which are incorporated herein by reference in their entirety) as further discussed below in less than 5 tanks of the spark ignition fuel composition. Measurement of clean-up per tank is discussed below in the Examples. Clean-up may also be measured by injector pulse width, injection duration, injector flow, or any combination of such methods. The synergistic combinations herein are surprisingly capable of achieving a percent LTFT reduction of about 15 to about 40 percent per tank of gasoline when combusted in a high pressure gasoline engine. Even more surprisingly and as shown in the Examples below, the synergistic combinations herein achieve rapid injector clean-up with about 40 to about 50 percent of the full clean-up obtainable in less than 500 miles of accumulated engine operation at high fuel pressures, which effectively means significant injector clean-up can be achieved in high pressure gasoline engine using one or at most two tanks of fuel including the additives herein.

Hydrocarbon Fuel: The base fuels used in formulating the fuel compositions of the present disclosure include any base fuels suitable for use in the operation of gasoline engines configured to combust fuel at the high fuel pressures discussed herein. Suitable fuels include leaded or unleaded motor gasolines, and so-called reformulated gasolines which typically contain both hydrocarbons of the gasoline boiling range and fuel-soluble oxygenated blending agents ("oxygenates"), such as alcohols, ethers and other suitable oxygen-containing organic compounds. Preferably, the fuel is a mixture of hydrocarbons boiling in the gasoline boiling range. This fuel may consist of straight chain or branch chain paraffins, cycloparaffins, olefins, aromatic hydrocarbons or any mixture of these. The gasoline can be derived from straight run naphtha, polymer gasoline, and natural gasoline or from catalytically reformed stocks boiling in the range from about 80° to about 450° F. The octane level of the gasoline is not critical and any conventional gasoline may be employed in the practice of this invention.

Oxygenates suitable for use in the present disclosure include methanol, ethanol, isopropanol, t-butanol, mixed C1 to C5 alcohols, methyl tertiary butyl ether, tertiary amyl methyl ether, ethyl tertiary butyl ether and mixed ethers. Oxygenates, when used, will normally be present in the base fuel in an amount below about 30% by volume, and preferably in an amount that provides an oxygen content in the overall fuel in the range of about 0.5 to about 5 percent by volume.

High pressure gasoline engines are engines known to those of ordinary skill that are configured to operate at non-idle gasoline fuel pressures greater than about 500 psi or greater than 1,000 psi and preferably at about 500 to about 7,500 psi (in other approaches, about 1,000 to about 7,500 psi, about 500 to about 4,000 psi, about 1,000 to about 4,000 psi, and in yet further approaches, about 500 to about 3,000 psi, or about 1,000 to about 3,000 psi). The hydrocarbon fuel boiling in the gasoline range may be spark-ignited or compression ignited at such high pressures. Such engines may include individual fuel injectors for each cylinder or combustion chamber of the engine. Suitable gasoline engines may include one or more high pressure pumps and suitable high pressure injectors configured to spray fuel into each cylinder or combustion chamber of the engine at the high pressures. In other approaches, the engines may be operated at temperatures effective to combust the gasoline under high compression and high pressure. Such engines are described, for example, in US patent references U.S. Pat. Nos. 8,235,024; 8,701,626; 9,638,146; US 20070250256; and/or US 20060272616 to suggest a few examples. In some instances, the gasoline engine may also be configured to operate at an air-to-gasoline weight ratio of about 40:1 or higher in the combustion chamber (in some approaches, about 40:1 to about 70:1 air-to-gasoline weight ratio) to deliver fuel at the high pressures noted herein.

Supplemental Fuel Additives: The fuel compositions of the present disclosure may also contain supplemental additives in addition to the fuel-soluble synergistic detergent mixture described above. For example, supplemental additives may include other dispersants/detergents, antioxidants, carrier fluids, metal deactivators, dyes, markers, corrosion inhibitors, biocides, antistatic additives, drag reducing agents, demulsifiers, emulsifiers, dehazers, anti-icing additives, antiknock additives, anti-valve-seat recession additives, lubricity additives, surfactants, combustion improvers, and mixtures thereof.

One particular additional additive may be a Mannich base detergent such as a separate intake valve deposit (IVD) control additive including a Mannich base detergent. Suitable Mannich base detergents for use in the fuel compositions herein include the reaction products of a high molecular weight alkyl-substituted hydroxyaromatic compound, aldehydes and amines. If used, the fuel composition may include about 45 to about 1000 ppm of a Mannich base detergent as a separate IVD control additive.

In one approach, the high molecular weight alkyl substituents on the benzene ring of the hydroxyaromatic compound may be derived from a polyolefin having a number average molecular weight (Mn) from about 500 to about 3000, preferably from about 700 to about 2100, as determined by gel permeation chromatography (GPC) using polystyrene as reference. The polyolefin may also have a polydispersity (weight average molecular weight/number average molecular weight) of about 1 to about 4 (in other instances, about 1 to about 2) as determined by GPC using polystyrene as reference.

The alkylation of the hydroxyaromatic compound is typically performed in the presence of an alkylating catalyst at a temperature in the range of about 0 to about 200° C., preferably 0 to 100° C. Acidic catalysts are generally used to promote Friedel-Crafts alkylation. Typical catalysts used in commercial production include sulphuric acid, $BF_3$, aluminum phenoxide, methanesulphonic acid, cationic exchange resin, acidic clays and modified zeolites.

Polyolefins suitable for forming the high molecular weight alkyl-substituted hydroxyaromatic compounds include polypropylene, polybutenes, polyisobutylene, copolymers of butylene and/or butylene and propylene, copolymers of butylene and/or isobutylene and/or propylene, and one or more mono-olefinic comonomers copolymerizable therewith (e.g., ethylene, 1-pentene, 1-hexene, 1-octene, 1-decene, etc.) where the copolymer molecule contains at least 50% by weight, of butylene and/or isobutylene and/or propylene units. The comonomers polymerized with propylene or such butenes may be aliphatic and can also contain non-aliphatic groups, e.g., styrene, o-methylstyrene, p-methylstyrene, divinyl benzene and the like. Thus in any case the resulting polymers and copolymers used in forming the high molecular weight alkyl-substituted hydroxyaromatic compounds are substantially aliphatic hydrocarbon polymers.

Polybutylene is preferred. Unless otherwise specified herein, the term "polybutylene" is used in a generic sense to include polymers made from "pure" or "substantially pure" 1-butene or isobutene, and polymers made from mixtures of two or all three of 1-butene, 2-butene and isobutene. Commercial grades of such polymers may also contain insignificant amounts of other olefins. So-called high reactivity polyisobutenes having relatively high proportions of polymer molecules having a terminal vinylidene group are also suitable for use in forming the long chain alkylated phenol reactant. Suitable high-reactivity polyisobutenes include those polyisobutenes that comprise at least about 20% of the more reactive methylvinylidene isomer, preferably at least 50% and more preferably at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808, which are both incorporated herein by reference.

The Mannich detergent may be made from a high molecular weight alkylphenol or alkylcresol. However, other phenolic compounds may be used including high molecular weight alkyl-substituted derivatives of resorcinol, hydroquinone, catechol, hydroxydiphenyl, benzylphenol, phenethylphenol, naphthol, tolylnaphthol, among others. Preferred for the preparation of the Mannich detergents are the polyalkylphenol and polyalkylcresol reactants, e.g., polypropylphenol, polybutylphenol, polypropylcresol and polybutylcresol, wherein the alkyl group has a number average molecular weight of about 500 to about 2100 as measured by GPC using polystyrene as reference, while the most preferred alkyl group is a polybutyl group derived from polyisobutylene having a number average molecular weight in the range of about 700 to about 1300 as measured by GPC using polystyrene as reference.

The preferred configuration of the high molecular weight alkyl-substituted hydroxyaromatic compound is that of a para-substituted mono-alkylphenol or a para-substituted mono-alkyl ortho-cresol. However, any hydroxyaromatic compound readily reactive in the Mannich condensation reaction may be employed. Thus, Mannich products made from hydroxyaromatic compounds having only one ring alkyl substituent, or two or more ring alkyl substituents are suitable for use in this invention. The long chain alkyl substituents may contain some residual unsaturation, but in general, are substantially saturated alkyl groups.

Representative amine reactants include, but are not limited to, alkylene polyamines having at least one suitably reactive primary or secondary amino group in the molecule. Other substituents such as hydroxyl, cyano, amido, etc., can be present in the polyamine. In a preferred embodiment, the alkylene polyamine is a polyethylene polyamine. Suitable alkylene polyamine reactants include ethylenediamine, diethylenetriamine, triethylenetetramine, tetraethylenepentamine and mixtures of such amines having nitrogen contents corresponding to alkylene polyamines of the formula $H_2N$-(A-NH—)$_n$H, where A in this formula is divalent ethylene or propylene and n is an integer of from 1 to 10, preferably 1 to 4. The alkylene polyamines may be obtained by the reaction of ammonia and dihalo alkanes, such as dichloro alkanes.

The amine may also be an aliphatic diamine having one primary or secondary amino group and at least one tertiary amino group in the molecule. Examples of suitable polyamines include N,N,N",N"-tetraalkyldialkylenetriamines (two terminal tertiary amino groups and one central secondary amino group), N,N,N',N"-tetraalkyltrialkylenetetramines (one terminal tertiary amino group, two internal tertiary amino groups and one terminal primary amino group), N,N,N',N",N"'-pentaalkyltrialkylenetetramines (one terminal tertiary amino group, two internal tertiary amino groups and one terminal secondary amino group), N,N-dihydroxyalkyl-alpha-, omega-alkylenediamines (one terminal tertiary amino group and one terminal primary amino group), N,N,N'-trihydroxyalkyl-alpha, omega-alkylenediamines (one terminal tertiary amino group and one terminal secondary amino group), tris(dialkylaminoalkyl)aminoalkylmethanes (three terminal tertiary amino groups and one terminal primary amino group), and similar compounds, wherein the alkyl groups are the same or different and typically contain no more than about 12 carbon atoms each, and which preferably contain from 1 to 4 carbon atoms each. Most preferably these alkyl groups are methyl and/or ethyl groups. Preferred polyamine reactants are N,N-dialkyl-alpha, omega-alkylenediamine, such as those having from 3 to about 6 carbon atoms in the alkylene group and from 1 to about 12 carbon atoms in each of the alkyl groups, which most preferably are the same but which can be different. Most preferred is N,N-dimethyl-1,3-propanediamine and N-methyl piperazine.

Examples of polyamines having one reactive primary or secondary amino group that can participate in the Mannich condensation reaction, and at least one sterically hindered amino group that cannot participate directly in the Mannich condensation reaction to any appreciable extent include N-(tert-butyl)-1,3-propanediamine, N-neopentyl-1,3-propanediamine-, N-(tert-butyl)-1-methyl-1,2-ethanediamine, N-(tert-butyl)-1-methyl-1,3-propanediamine, and 3,5-di(tert-butyl)aminoethylpiperazine.

Representative aldehydes for use in the preparation of the Mannich base products include the aliphatic aldehydes such as formaldehyde, acetaldehyde, propionaldehyde, butyraldehyde, valeraldehyde, caproaldehyde, heptaldehyde, stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. Most preferred is formaldehyde or formalin.

The condensation reaction among the alkylphenol, the specified amine(s) and the aldehyde may be conducted at a temperature typically in the range of about 40° C. to about 200° C. The reaction can be conducted in bulk (no diluent or solvent) or in a solvent or diluent. Water is evolved and can be removed by azeotropic distillation during the course of the reaction. Typically, the Mannich reaction products are formed by reacting the alkyl-substituted hydroxyaromatic compound, the amine and aldehyde in the molar ratio of 1.0:0.5-2.0:1.0-3.0, respectively.

Suitable Mannich base detergents include those detergents taught in U.S. Pat. Nos. 4,231,759; 5,514,190; 5,634,951; 5,697,988; 5,725,612; and 5,876,468, the disclosures of which are incorporated herein by reference.

Another suitable additional fuel additive may be a hydrocarbyl amine detergents. If used, the fuel composition may include about 45 to about 1000 ppm of the hydrocarbyl amine detergent. One common process involves halogenation of a long chain aliphatic hydrocarbon such as a polymer of ethylene, propylene, butylene, isobutene, or copolymers such as ethylene and propylene, butylene and isobutylene, and the like, followed by reaction of the resultant halogenated hydrocarbon with a polyamine. If desired, at least some of the product can be converted into an amine salt by treatment with an appropriate quantity of an acid. The products formed by the halogenation route often contain a small amount of residual halogen such as chlorine. Another way of producing suitable aliphatic polyamines involves controlled oxidation (e.g., with air or a peroxide) of a polyolefin such as polyisobutene followed by reaction of the oxidized polyolefin with a polyamine. For synthesis details for preparing such aliphatic polyamine detergent/dispersants, see for example U.S. Pat. Nos. 3,438,757; 3,454,555; 3,485,601; 3,565,804; 3,573,010; 3,574,576; 3,671,511; 3,746,520; 3,756,793; 3,844,958; 3,852,258; 3,864,098; 3,876,704; 3,884,647; 3,898,056; 3,950,426; 3,960,515; 4,022,589; 4,039,300; 4,128,403; 4,166,726; 4,168,242; 5,034,471; 5,086,115; 5,112,364; and 5,124,484; and published European Patent Application 384,086. The disclosures of each of the foregoing documents are incorporated herein by reference. The long chain substituent(s) of the hydrocarbyl amine detergent most preferably contain(s) an average of 40 to 350 carbon atoms in the form of alkyl or alkenyl groups (with or without a small residual amount of halogen substitution). Alkenyl substituents derived from poly-alpha-olefin homopolymers or copolymers of appropriate molecular weight (e.g., propene homopolymers, butene homopolymers, C3 and C4 alpha-olefin copolymers, and the like) are suitable. Most preferably, the substituent is a polyisobutenyl group formed from polyisobutene having a number average molecular weight (as determined by gel permeation chromatography) in the range of 500 to 2000, preferably 600 to 1800, most preferably 700 to 1600.

Polyetheramines are yet another suitable additional detergent chemistry used in the methods of the present disclosure. If used, the fuel composition may include about 45 to about 1000 ppm of the polyetheramine detergents. The polyether backbone in such detergents can be based on propylene oxide, ethylene oxide, butylene oxide, or mixtures of these. The most preferred are propylene oxide or butylene oxide or mixture thereof to impart good fuel solubility. The polyetheramines can be monoamines, diamines or triamines. Examples of commercially available polyetheramines are those under the tradename Jeffamines™ available from Huntsman Chemical company and the poly(oxyalkylene) carbamates available from Chevron Chemical Company. The molecular weight of the polyetheramines will typically range from 500 to 3000. Other suitable polyetheramines are those compounds taught in U.S. Pat. Nos. 4,191,537; 4,236,020; 4,288,612; 5,089,029; 5,112,364; 5,322,529; 5,514,190 and 5,522,906.

In some approaches, the fuel-soluble synergistic detergent mixture may also be used with a liquid carrier or induction aid. Such carriers can be of various types, such as for example liquid poly-α-olefin oligomers, mineral oils, liquid poly(oxyalkylene) compounds, liquid alcohols or polyols, polyalkenes, liquid esters, and similar liquid carriers. Mixtures of two or more such carriers can be employed.

Exemplary liquid carriers may include a mineral oil or a blend of mineral oils that have a viscosity index of less than about 120; one or more poly-α-olefin oligomers; one or more poly(oxyalkylene) compounds having an average molecular weight in the range of about 500 to about 3000; polyalkenes; polyalkyl-substituted hydroxyaromatic compounds; or mixtures thereof. The mineral oil carrier fluids that can be used include paraffinic, naphthenic and asphaltic oils, and can be derived from various petroleum crude oils and processed in any suitable manner. For example, the mineral oils may be solvent extracted or hydrotreated oils. Reclaimed mineral oils can also be used. Hydrotreated oils are the most preferred. Preferably the mineral oil used has a viscosity at 40° C. of less than about 1600 SUS, and more preferably between about 300 and 1500 SUS at 40° C. Paraffinic mineral oils most preferably have viscosities at 40° C. in the range of about 475 SUS to about 700 SUS. In some instances, the mineral oil may have a viscosity index of less than about 100, in other instances, less than about 70 and, in yet further instances, in the range of from about 30 to about 60.

The poly-α-olefins (PAO) suitable for use as carrier fluids are the hydrotreated and unhydrotreated poly-α-olefin oligomers, such as, hydrogenated or unhydrogenated products, primarily trimers, tetramers and pentamers of alpha-olefin monomers, which monomers contain from 6 to 12, generally 8 to 12 and most preferably about 10 carbon atoms. Their synthesis is outlined in Hydrocarbon Processing, February 1982, page 75 et seq., and in U.S. Pat. Nos. 3,763,244; 3,780,128; 4,172,855; 4,218,330; and 4,950,822. The usual process essentially comprises catalytic oligomerization of short chain linear alpha olefins (suitably obtained by catalytic treatment of ethylene). The poly-α-olefins used as carriers will usually have a viscosity (measured at 100° C.) in the range of 2 to 20 centistokes (cSt). Preferably, the poly-α-olefin has a viscosity of at least 8 cSt, and most preferably about 10 cSt at 100° C.

Suitable poly (oxyalkylene) compounds for the carrier fluids may be fuel-soluble compounds which can be represented by the following formula $$R_A—(R_B—O)_w—R_C$$

wherein $R_A$ is typically a hydrogen, alkoxy, cycloalkoxy, hydroxy, amino, hydrocarbyl (e.g., alkyl, cycloalkyl, aryl, alkylaryl, aralkyl, etc.), amino-substituted hydrocarbyl, or hydroxy-substituted hydrocarbyl group, $R_B$ is an alkylene group having 2 to 10 carbon atoms (preferably 2-4 carbon atoms), $R_C$ is typically a hydrogen, alkoxy, cycloalkoxy, hydroxy, amino, hydrocarbyl (e.g., alkyl, cycloalkyl, aryl, alkylaryl, aralkyl, etc.), amino-substituted hydrocarbyl, or hydroxy-substituted hydrocarbyl group, and w is an integer from 1 to 500 and preferably in the range of from 3 to 120 representing the number (usually an average number) of repeating alkyleneoxy groups. In compounds having multiple —$R_B$—O— groups, $R_B$ can be the same or different alkylene group and where different, can be arranged randomly or in blocks. Preferred poly (oxyalkylene) compounds are monools comprised of repeating units formed by reacting an alcohol with one or more alkylene oxides, preferably one alkylene oxide, more preferably propylene oxide or butylene oxide.

The average molecular weight of the poly (oxyalkylene) compounds used as carrier fluids is preferably in the range of from about 500 to about 3000, more preferably from about 750 to about 2500, and most preferably from above about 1000 to about 2000.

One useful sub-group of poly (oxyalkylene) compounds is comprised of the hydrocarbyl-terminated poly(oxyalkylene) monools such as are referred to in the passage at column 6, line 20 to column 7 line 14 of U.S. Pat. No. 4,877,416 and references cited in that passage, said passage and said references being fully incorporated herein by reference.

Another sub-group of poly (oxyalkylene) compounds includes one or a mixture of alkylpoly (oxyalkylene)monools which in its undiluted state is a gasoline-soluble liquid having a viscosity of at least about 70 centistokes (cSt) at 40° C. and at least about 13 cSt at 100° C. Of these compounds, monools formed by propoxylation of one or a mixture of alkanols having at least about 8 carbon atoms, and more preferably in the range of about 10 to about 18 carbon atoms, are particularly preferred.

The poly (oxyalkylene) carriers may have viscosities in their undiluted state of at least about 60 cSt at 40° C. (in other approaches, at least about 70 cSt at 40° C.) and at least about 11 cSt at 100° C. (more preferably at least about 13 cSt at 100° C.). In addition, the poly (oxyalkylene) compounds used in the practice of this invention preferably have viscosities in their undiluted state of no more than about 400 cSt at 40° C. and no more than about 50 cSt at 100° C. In other approaches, their viscosities typically do not exceed about 300 cSt at 40° C. and typically do not exceed about 40 cSt at 100° C.

Preferred poly (oxyalkylene) compounds also include poly (oxyalkylene) glycol compounds and monoether derivatives thereof that satisfy the above viscosity requirements and that are comprised of repeating units formed by reacting an alcohol or polyalcohol with an alkylene oxide, such as propylene oxide and/or butylene oxide with or without use of ethylene oxide, and especially products in which at least 80 mole % of the oxyalkylene groups in the molecule are derived from 1,2-propylene oxide. Details concerning preparation of such poly(oxyalkylene) compounds are referred to, for example, in Kirk-Othmer, Encyclopedia of Chemical Technology, Third Edition, Volume 18, pages 633-645 (Copyright 1982 by John Wiley & Sons), and in references cited therein, the foregoing excerpt of the Kirk-Othmer encyclopedia and the references cited therein being incorporated herein by reference. U.S. Pat. Nos. 2,425,755; 2,425,845; 2,448,664; and 2,457,139 also describe such procedures, and are fully incorporated herein by reference.

The poly (oxyalkylene) compounds, when used, typically will contain a sufficient number of branched oxyalkylene units (e.g., methyldimethyleneoxy units and/or ethyldimethyleneoxy units) to render the poly (oxyalkylene) compound gasoline soluble. Suitable poly (oxyalkylene) compounds include those taught in U.S. Pat. Nos. 5,514,190; 5,634,951; 5,697,988; 5,725,612; 5,814,111 and 5,873,917, the disclosures of which are incorporated herein by reference.

The polyalkenes suitable for use as carrier fluids include polypropene and polybutene. The polyalkenes may have a polydispersity (Mw/Mn) of less than 4. In one embodiment, the polyalkenes have a polydispersity of 1.4 or below. In general, polybutenes have a number average molecular weight (Mn) of about 500 to about 2000, preferably 600 to about 1000, as determined by gel permeation chromatography (GPC). Suitable polyalkenes for use in the present invention are taught in U.S. Pat. No. 6,048,373.

The polyalkyl-substituted hydroxyaromatic compounds suitable for use as carrier fluid include those compounds known in the art as taught in U.S. Pat. Nos. 3,849,085; 4,231,759; 4,238,628; 5,300,701; 5,755,835 and 5,873,917, the disclosures of which are incorporated herein by reference.

Definitions

For purposes of this disclosure, the chemical elements are identified in accordance with the Periodic Table of the Elements, CAS version, Handbook of Chemistry and Physics, 75th Ed. Additionally, general principles of organic chemistry are described in "Organic Chemistry", Thomas Sorrell, University Science Books, Sausolito: 1999, and "March's Advanced Organic Chemistry", 5th Ed., Ed.: Smith, M. B. and March, J., John Wiley & Sons, New York: 2001, the entire contents of which are hereby incorporated by reference.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

As described herein, compounds may optionally be substituted with one or more substituents, such as are illustrated generally above, or as exemplified by particular classes, subclasses, and species of the disclosure.

As used herein, an "alkyl" group refers to a saturated aliphatic hydrocarbon group containing (unless otherwise noted in this disclosure) 1-12 (e.g., 1-8, 1-6, or 1-4) carbon atoms. An alkyl group can be straight or branched. Examples of alkyl groups include, but are not limited to, methyl, ethyl, propyl, isopropyl, butyl, isobutyl, sec-butyl, tert-butyl, n-pentyl, n-heptyl, or 2-ethylhexyl. An alkyl group can be substituted (i.e., optionally substituted) with one or more substituents such as halo, phospho, cycloaliphatic [e.g., cycloalkyl or cycloalkenyl], heterocycloaliphatic [e.g., heterocycloalkyl or hetero cycloalkenyl], aryl, heteroaryl, alkoxy, aroyl, heteroaroyl, acyl [e.g., (aliphatic)carbonyl, (cycloaliphatic)carbonyl, or (heterocycloaliphatic)carbonyl], nitro, cyano, amido [e.g., (cycloalkylalkyl)carbonylamino, arylcarbonylamino, aralkylcarbonylamino, (heterocyclo alkyl)carbonylamino, (heterocycloalkylalkyl) carbonylamino, heteroarylcarbonylamino, heteroaralkylcarbonylamino alkylaminocarbonyl, cycloalkylaminocarbonyl, heterocyclo alkylaminocarbonyl, arylaminocarbonyl, or heteroarylaminocarbonyl], amino [e.g., aliphaticamino, cycloaliphaticamino, or heterocycloaliphaticamino], sulfonyl [e.g., aliphatic-$SO_2$—], sulfinyl, sulfanyl, sulfoxy, urea, thiourea, sulfamoyl, sulfamide, oxo, carboxy, carbamoyl, cycloaliphaticoxy, heterocycloaliphaticoxy, aryloxy, heteroaryloxy, aralkyloxy, heteroarylalkoxy, alkoxycarbonyl, alkylcarbonyloxy, or hydroxy. Without limitation, some examples of substituted alkyls include carboxyalkyl (such as HOOC-alkyl, alkoxy carbonylalkyl, and alkyl carbonyloxyalkyl), cyanoalkyl, hydroxyalkyl, alkoxyalkyl, acylalkyl, aralkyl, (alkoxyaryl)alkyl, (sulfonylamino)alkyl (such as (alkyl-$SO_2$-amino)alkyl), aminoalkyl, amidoalkyl, (cycloaliphatic) alkyl, or haloalkyl.

As used herein, an "alkenyl" group refers to an aliphatic carbon group that contains (unless otherwise noted in this disclosure) 2-8 (e.g., 2-12, 2-6, or 2-4) carbon atoms and at least one double bond. Like an alkyl group, an alkenyl group can be straight or branched. Examples of an alkenyl group include, but are not limited to allyl, isoprenyl, 2-butenyl, and 2-hexenyl. An alkenyl group can be optionally substituted with one or more substituents such as halo, phospho, cycloaliphatic [e.g., cycloalkyl or cycloalkenyl], heterocycloaliphatic [e.g., heterocycloalkyl or hetero cycloalkenyl], aryl, heteroaryl, alkoxy, aroyl, heteroaroyl, acyl [e.g., (aliphatic) carbonyl, (cycloaliphatic)carbonyl, or (heterocycloaliphatic) carbonyl], nitro, cyano, amido [e.g., (cycloalkylalkyl)carbonylamino, aryl carbonyl amino, aralkylcarbonylamino, (hetero cycloalkyl) carbonylamino, (heterocyclo alkylalkyl) carbonylamino, heteroarylcarbonylamino, heteroaralkylcarbonylamino alkylaminocarbonyl, cycloalkylaminocarbonyl, hetero cyclo alkyl aminocarbonyl, arylaminocarbonyl, or heteroarylaminocarbonyl], amino [e.g., aliphaticamino, cycloaliphaticamino, heterocyclo aliphaticamino, or aliphaticsulfonylamino], sulfonyl [e.g., alkyl-$SO_2$—, cycloaliphatic-$SO_2$—, or aryl-$SO_2$—], sulfinyl, sulfanyl, sulfoxy, urea, thiourea, sulfamoyl, sulfamide, oxo, carboxy, carbamoyl, cycloaliphaticoxy, heterocycloaliphaticoxy, aryloxy, heteroaryloxy, aralkyloxy, heteroaralkoxy, alkoxycarbonyl, alkylcarbonyloxy, or hydroxy. Without limitation, some examples of substituted alkenyls include cyanoalkenyl, alkoxyalkenyl, acylalkenyl, hydroxyalkenyl, aralkenyl, (alkoxyaryl)alkenyl, (sulfonylamino)alkenyl (such as (alkyl-$SO_2$-amino)alkenyl), aminoalkenyl, amidoalkenyl, (cycloaliphatic)alkenyl, or haloalkenyl.

A hydrocarbyl group refers to a group that has a carbon atom directly attached to a remainder of the molecule and each hydrocarbyl group is independently selected from hydrocarbon substituents, and substituted hydrocarbon substituents may contain one or more of halo groups, hydroxyl groups, alkoxy groups, mercapto groups, nitro groups, nitroso groups, amino groups, sulfoxy groups, pyridyl groups, furyl groups, thienyl groups, imidazolyl groups, sulfur, oxygen and nitrogen, and wherein no more than two non-hydrocarbon substituents are present for every ten carbon atoms in the hydrocarbyl group.

As used herein, fuel-soluble generally means that the substance should be sufficiently soluble (or dissolve) at about 20° C. in the base fuel at least at the minimum concentration required for the substance to serve its intended function. Preferably, the substance will have a substantially greater solubility in the base fuel. However, the substance need not dissolve in the base fuel in all proportions.

The number average molecular weight (Mn) for any approach, aspect, embodiment or Example herein may be determined with a gel permeation chromatography (GPC) instrument obtained from Waters or the like instrument and data as processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Unstabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1-0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

A better understanding of the present disclosure and its many advantages may be clarified with the following examples. The following examples are illustrative and not limiting thereof in either scope or spirit. Those skilled in the art will readily understand that variations of the components, methods, steps, and devices described in these examples can be used. Unless noted otherwise or apparent from the context of discussion, all percentages, ratios, and parts noted in this disclosure are by weight.

EXAMPLES

Example 1

Experiments were performed to evaluate the fuel injector clean-up performance of various fuel additives when combusted in gasoline engines that were operated at high fuel pressures. Table 1 below illustrates the clean-up performance of a gasoline engine injecting the fuel and additives between about 580 to about 1,980 psi. The additives evaluated included a comparative PIBSA-TEPA additive only, a comparative imidazoline additive only, and inventive synergistic combinations of the PIBSA-TEPA and imidazoline. Fuel injector deposit clean-up is measured per SAE 2013-01-2626 or SAE 2013-01-2616, which are reproduced herein in its entirety. Determining the number of tanks of fuel to achieve clean-up was calculated from the reported MPG of the particular test vehicle. For instance, the city MPG and highway MPG from the vehicle window sticker (as known as a Monroney label) was determined and then averaged. For instance, if the city MPG is 25 and the highway MPG is 33, then for purposes of evaluations in this disclosure, MPG was considered to be an average of 29 MPG. The vehicle tank size was then considered relative to the averaged MPG to determine number of miles per one tank of fuel. For instance, if the tank size is 16 gallons, then for the evaluations herein, one tank of fuel would be 464 miles (29 MPG×16 gallons). This protocol was used in the evaluations in these Examples and throughout this disclosure.

For this evaluation, comparative sample 1 was a PIBSA-TEPA succinimide detergent having a PIB moiety with a number average molecular weight of about 950. As shown in Table 1, this succinimide did not provide any clean-up performance of fouled fuel injectors when combusted in the high pressure gasoline engine. Next, a mono-fatty hydroxy imidazoline obtained from oleic acid and 2-aminoethylamino ethanol was evaluated as the fuel additive by itself. As shown by comparative sample 2 in Table 1 below, while the mono-fatty hydroxyl imidazoline demonstrated some clean-up performance, it took several tanks of fuel and this additive only evidenced a moderate % LTFT improvement per tank of fuel.

However, as shown by inventive samples 3 and 4, combinations of the PIMA-TEPA additive and the mono-fatty hydroxyl imidazoline additive together demonstrated a dramatically improved and more rapid fuel injector clean-up at the high fuel pressures. In the presence of only 1.9 ppmw of PIBSA-TEPA and only 3.8 ppmw of imidazoline (total of 5.7 ppmw of additive mixture) achieved 100% clean-up over the course of only 4 tanks of vehicle operation (Sample 3). This unexpected synergetic combination amounts to about a 48% increase in injector clean-up rate to achieve full clean-up at only 5.7 ppmw of active additive componentry (compared to twice as much (that is, 11.4 ppmw) of the imidazoline alone to achieve full clean-up in double the amount of tanks). Such rapid fuel injector clean-up at high fuel pressure can also be achieved by inverting the treat rates of the imidazoline and succinimide (Sample 4, Table 1).

TABLE 1

DIG Clean up Data

| ID | Succinimide (ppmw) | Imidazoline (ppmw) | Clean-Up (%) | Tanks Clean-Up | % LTFT/tank |
|---|---|---|---|---|---|
| 1 | 7.6 | 0 | 0 | n/a | n/a |
| 2 | 0 | 11.4 | 100 | 8 | 13 |
| 3 | 1.9 | 3.8 | 100 | 4 | 25 |
| 4 | 3.8 | 1.9 | 64 | 2 | 32 |

Example 2

Another evaluation was conducted to measure clean-up performance based on accumulated mileage when combusting a fuel and additives in a high pressure gasoline engine operating between about 580 and about 1,980 psi. As shown in FIG. 1, the additives of Example 1 were evaluated according to SAE paper(s) of Example 1.

As shown in FIG. 1, while the imidazoline cleaning additive alone provided a modest level of fuel injector clean-up at 11.4 ppmw when combusted in a gasoline engine operated at about 580 to about 1,960 psi fuel injection, the PIBSA-TEPA additive provided no clean-up performance in the high pressure fuel at 7.6 ppmw. However, adding the PIBSA-TEPA in combination with the imidazoline (2:1 or 1:2 ratio) demonstrated a profound increase and more rapid fuel injector clean-up performance when operating at the high gasoline fuel injection pressures. Given that the PM SA-TEPA additive had no clean-up performance in the high pressure gasoline engine at 7.6 ppmw, it was not expected that a combination of the PIBSA-TEPA and the imidazoline would result in an increased, much less, a more rapid clean-up rate relative to the imidazoline alone. As shown in FIG. 1, the inventive synergistic combinations of the two additives delivered about double the clean-up performance of the imidazoline alone in less than 500 miles of operating the engine at high fuel pressures (and compared to the imidazoline that was used individually at twice the active treat rate). That is, at less than 500 miles of engine operation, the imidazoline alone achieved only about 20 percent of injector clean-up while the inventive combinations achieved double or more clean-up performance providing about 40 to about 50 percent of engine clean-up in less than 500 miles of engine operation.

It is to be understood that while the fuel additives and compositions of this disclosure have been described in conjunction with the detailed description thereof and summary herein, the foregoing description is intended to illustrate and not limit the scope of the disclosure, which is defined by the scope of the appended claims. Other aspects, advantages, and modifications are within the scope of the claims. It is intended that the specification and examples be considered as exemplary only, with a true scope of the disclosure being indicated by the following claims.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification are to be understood as being modified in all instances by the term "about," whether or not the term "about" is present. Accordingly, unless indicated to the contrary, the numerical parameters set forth in the specification are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, a range of from 1 to 4 is to be interpreted as an express disclosure of the values 1, 2, 3 and 4 as well as any range of such values such as 1 to 4, 1 to 3, 1 to 2, 2 to 4, 2 to 3 and so forth.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. A method of reducing fuel injector deposits in a gasoline engine, the method comprising:

providing a fuel composition at a pressure of about 500 to about 2,000 psi to a fuel injector of a gasoline engine and combusting the fuel composition in the gasoline engine;

the fuel composition including a major amount of gasoline and a minor amount of a fuel injector clean-up mixture;

the fuel injector clean-up mixture including about 1 to about 20 ppm of a first additive of a heterocyclic amine of Formula I, an open chain derivative thereof, or mixtures thereof and about 1 to about 20 ppm of a second additive of Formula II (Formula I)

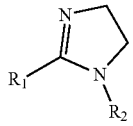

(Formula II)

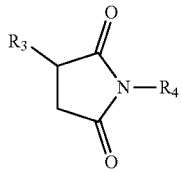

wherein $R_1$ is a hydrocarbyl group having 14 to 20 carbons; and $R_2$ is a hydroxyalkyl group having 1 to 10 carbons;

$R_3$ is a hydrocarbyl group derived from a polyisobutylene having a number average molecular weight of about 700 to about 1000;

$R_4$ is a polyamine derived from triethylene tetraamine, tetraethylene pentamine, pentaethylene hexamine, or combinations thereof; and wherein the fuel composition contains a ratio between the first additive to the second additive of about 2:1 to about 1:2; and wherein the fuel injector clean-up mixture achieves about 40 to about 60 percent of the fuel injector clean-up in less than 500 miles.

2. The method of reducing fuel injector deposits in a gasoline engine according to claim 1, wherein the fuel composition includes about 1.5 to about 10 ppmw of the first additive and about 3 to about 10 ppmw of the second additive.

3. The method of reducing fuel injector deposits in a gasoline engine according to claim 1, wherein the fuel composition includes no more than about 20 ppmw of the fuel injector clean-up mixture.

4. The method of reducing fuel injector deposits in a gasoline engine according to claim 1, wherein the fuel composition further includes about 45 to about 1000 ppmw of a separate intake valve deposit (IVD) control additive selected from a Mannich detergent, polyetheramine detergent, hydrocarbyl amine detergent, and combinations thereof.

5. The method of reducing fuel injector deposits in a gasoline engine according to claim 4, wherein the fuel composition further includes at least one additive selected from the group consisting of antioxidants, carrier fluids, metal deactivators, dyes, markers, corrosion inhibitors, biocides, antistatic additives, drag reducing agents, demulsifiers, emulsifiers, dehazers, anti-icing additives, antiknock additives, anti-valve-seat recession additives, lubricity additives, surfactants and combustion improvers.

6. The method of reducing fuel injector deposits in a gasoline engine according to claim 1, wherein the clean-up of injector deposits is measured by at least one of long-term fuel trim, injector pulse width, injection duration, injector flow, and combinations thereof.

7. The method of reducing fuel injector deposits in a gasoline engine according to claim 1, wherein $R_2$ is a hydroxy methyl group, a hydroxyl ethyl group, a hydroxyl propyl group, or mixtures thereof.

8. The method of reducing fuel injector deposits in a gasoline engine according to claim 1, wherein $R_2$ is a hydroxyalkyl group having 1 to 5 carbons.

9. The method of reducing fuel injector deposits in a gasoline engine according to claim 1, wherein $R_4$ is derived from tetraethylene pentamine or derivatives thereof.

10. The method of reducing fuel injector deposits in a gasoline engine according to claim 1, wherein the fuel composition is provided at a pressure of about 1000 to about 2000 psi.

11. A fuel additive concentrate for use in gasoline to clean-up fuel injector deposits in a high-pressure gasoline engine, the fuel additive concentrate comprising:

a fuel injector clean-up mixture including about 1 to about 20 ppm of a first additive of a heterocyclic amine of Formula I, an open chain derivative thereof, or mixtures thereof and about 1 to about 20 ppm of a second additive of Formula II (Formula I)

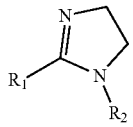

(Formula II)

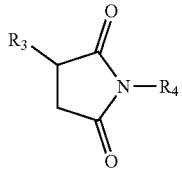

wherein $R_1$ is a hydrocarbyl group having 14 to 20 carbons; and $R_2$ is a hydroxyalkyl group having 1 to 10 carbons;

$R_3$ is a hydrocarbyl group derived from a polyisobutylene having a number average molecular weight of about 700 to about 1000;

$R_4$ is a polyamine derived from triethylene tetraamine, tetraethylene pentamine, pentaethylene hexamine, or combinations thereof;

a ratio of the first additive to the second additive of about 2:1 to about 1:2; and when the fuel additive concentrate is added to gasoline in the ratio of the first additive to the second additive, the fuel injector clean-up mixture achieves about 50 to about 100 percent clean-up of fuel injector deposits in 5 tanks of fuel or less when the gasoline is supplied at pressure of about 500 to about 2000 psi and when the clean-up of injector deposits is measured by at least one of long-term fuel trim, injector pulse width, injection duration, injector flow, and combinations thereof.

12. The fuel additive concentrate of claim 11, wherein $R_1$ is derived from.

13. The fuel additive concentrate of claim 12, wherein $R_2$ is selected from a hydroxy methyl group, a hydroxy ethyl group, a hydroxy propyl group, and mixtures thereof.

14. The fuel additive concentrate of claim 11, wherein $R_2$ is a hydroxyalkyl group having 1 to 5 carbons.

15. The fuel additive concentrate of claim 11, wherein $R_4$ is derived from tetraethylene pentamine or derivatives thereof.

* * * * *